United States Patent [19]

Fylling

[11] 4,152,972

[45] May 8, 1979

[54] TORQUE APPLICATOR

[76] Inventor: Tor T. Fylling, Olaf Schous vei 18, Oslo 5, Norway

[21] Appl. No.: 776,434

[22] Filed: Mar. 10, 1977

[30] Foreign Application Priority Data

Mar. 12, 1976 [NO] Norway ..... 760872

[51] Int. Cl.[2] ..... F01B 3/00

[52] U.S. Cl. ..... 92/33; 92/31

[58] Field of Search ..... 92/31–33, 92/29, 62, 136; 74/88; 123/179 F; 91/53

[56] References Cited

U.S. PATENT DOCUMENTS

| | | | |
|---|---|---|---|
| 3,141,387 | 7/1964 | Geyer | 92/33 |
| 3,153,986 | 10/1964 | Mitchell | 92/33 |
| 3,353,454 | 11/1967 | Donovan | 92/29 X |

FOREIGN PATENT DOCUMENTS

| | | | |
|---|---|---|---|
| 2115707 | 2/1972 | Fed. Rep. of Germany | 92/33 |

*Primary Examiner*—Irwin C. Cohen

*Attorney, Agent, or Firm*—Watson, Cole, Grindle & Watson

[57] ABSTRACT

A torque applicator includes a house and a stem extending through a bore therein, the stem including teeth which are engageable with teeth disposed on a piston axially movable within the bore and positioned between an inner wall of the house and the stem. The piston is further engageable with an axially movable element which is positioned between the piston and the inner wall of the house, the axially movable element including teeth which are engageable with teeth disposed on the inner wall of the house.

7 Claims, 2 Drawing Figures

TORQUE APPLICATOR

BACKGROUND OF THE INVENTION

The present invention relates to a torque applicator comprising a house in which is disposed a rotatable torque applicator stem actuated by a hydraulic or pneumatic double-acting piston and intended to apply an intermittent torque on bolts, nuts, etc. A torque applicator of this kind is known from the Norwegian Patent No. 115.991. The present invention is a further development and a simplification of the previously known embodiment just referred to.

SUMMARY OF THE INVENTION

The torque applicator of the present invention differs from the prior art in that the torque applicator stem over part of its length is provided with axially extending teeth or helical teeth which mesh with corresponding teeth on the double-acting piston, that the house over part of its length is interiorally provided with helical teeth meshing with corresponding teeth on an axially movable element, and that the axially movable element through a coupling device is adapted to be engaged to and disengaged from the double-acting piston.

Further features of the torque applicator of the present invention will appear from the accompanying drawings and the associated explanatory discussion.

DESCRIPTION OF THE PREFERRED EMBODIMENT

Figure 1:
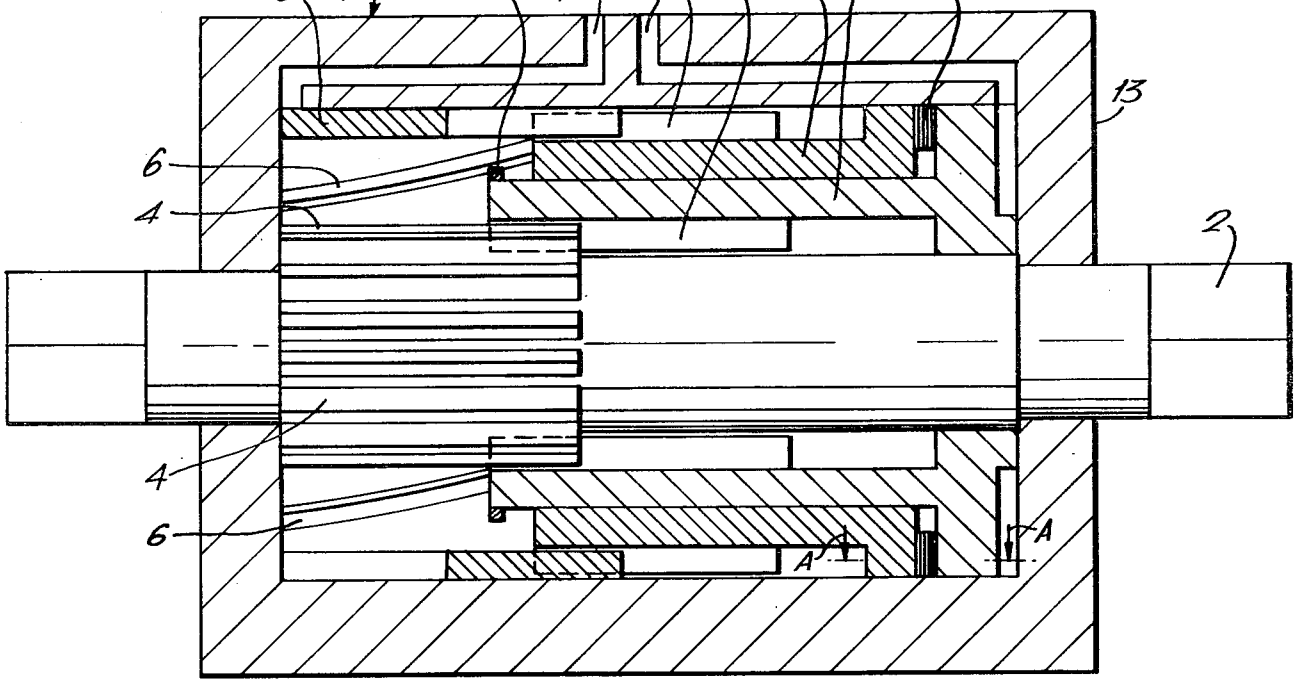
FIG. 1 shows a schematic axial section through a torque applicator according to one embodiment of the present invention.
Figure 2:
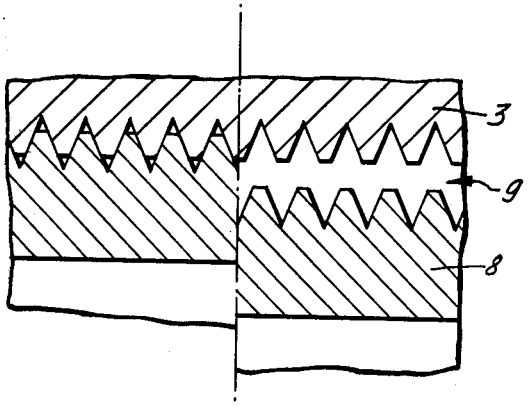
FIG. 2 shows a sectional view taken along line A—A of FIG. 1, the left-hand part showing interengagement of the coupling parts, and the right-hand part showing the out of engagement positioning thereof.

FIG. 1 shows a section through a pressure-activated torque applicator comprising a house 1 with a through bore in which a torque applicator stem 2 and its torque providing devices are disposed. The stem 2 is actuated by a hydraulic or pneumatic double-acting piston 3. According to the invention, the stem 2 is provided over part of its length with axial or helical teeth 4 meshing with corresponding teeth 5 on the double-acting piston 3. Further, according to the invention, the house 1 is provided on its inner wall over part of its length with helical teeth 6 meshing with corresponding teeth 7 on an axially movable element 8, which element 8 may be engaged to and disengaged from the double-acting piston 3 through a coupling device 9 as depicted in FIG. 2. The left and right hand parts of FIG. 2 showing the coupling device engaged and disengaged, respectively. Of course, the helix angle of the teeth 4 and 5 (if being helical teeth) should not be equal to the helix angle of the teeth 6 and 7. in the shown embodiment, in which the head of the double-acting piston 3 completely fills out the cross section of the annular space between the stem 2 and the inner wall of the house 1, the axially movable element 8 is adapted to be moved on a portion of the piston 3 having reduced diameter, whereas the coupling device 9 in the embodiment shown is in the form of mutually co-acting teeth on confronting faces on the element 8 and the piston 3, respectively.

The confronting faces on the element 8 and the piston 3 may be radial or substantially radial surfaces or they may be complementary conical surfaces or even cylindrical surfaces.

In operation of the torque applicator, a hydraulic or pneumatic fluid is passed into and out of the house 1 through passages 10 and 11 which both lead to a turn over valve (not shown) and communicate with a source of pressure. The house 1 is locked against rotation by means of a suitable device not shown.

When the pressurized fluid is passed in through the passage 10 to the space between the piston 3 and the end wall of the house 1, the piston and thus also the movable element 8 are forced away from the end wall 13 of the house, i.e. towards the left in FIG. 1. Because the coupling 9 is engaged, the helical teeth 6, 7 on the house 1 and the element 8 respectively will cause a rotation of the element 8 and thus of the piston 3 with respect to the house 1, and thus even the stem 2 will rotate. On reversal of the pressure direction the pressurized fluid will pass through the passage 11 into the cylinder space on the second side of the piston 3 and thus the piston 3 will move away from the element 8, i.e. towards right on the drawing, so that the coupling 9 is disengaged and the piston 3 is moved to its original position, a catch 14 on the piston 3 pushing up the element 8. During this return motion and since the coupling 9 is disengaged, the element 8 will rotate with respect to the house 1 and freely of the piston 3 which may or may not rotate with respect to the house 1, depending upon whether the teeth 4, 5 are helical or axial. In any case, during this return movement there will be no rotation of the stem 2. When once more reversing the pressure, the piston 3 will again be forced against the element 8 to the effect that the coupling 9 engages and the procedure is repeated.

By means of the pressure in the system (the passages 10 and 11) the torque applied to the torque applicator may be gauged, and if desired, the turn over valve may be supplemented by a limiting device breaking the pressure supply at the achievement of a predetermined pressure, and consequently of a predetermined torque.

What I claim is:

1. A torque applicator which comprises a house which includes an inner wall forming an axial through bore therein;

helical teeth disposed along a portion of the inner wall of said house;

a torque applicator stem rotatably positioned to extend through said through bore in said house;

teeth disposed along a portion of the surface of said torque applicator stem which is positioned within said through bore;

a hydraulic or pneumatic doubleacting piston positioned within said through bore in said house between said inner wall of said house and said torque applicator stem; said piston being axially movable within said through bore, said piston including a head portion which extends between said torque applicator stem and said inner wall of said house and an elongated portion of a smaller dimension;

an element positioned within said through bore in said housing and between said elongated portion of said piston and said inner wall of said house; said element being axially movable within said through bore;

teeth disposed along said doubleacting piston engaging with said teeth disposed along a portion of the surface of said torque applicator stem;

teeth disposed along said element engaged with said helical teeth disposed along a portion of the inner wall of said house; and teeth means between said head portion of said piston and said element which is functional to alternatively engage or disengage in a positive fashion said piston and said element.

2. The torque applicator as defined in claim 1, wherein said teeth means capable of engaging said piston and said element is a device having two faces, one facing said element and the second facing said head portion of said piston, wherein each of said two faces of said device includes teeth, and wherein each of said element and said head of said piston include corresponding facing teeth for coacting with the respective teeth on the faces of said device.

3. The torque applicator as defined in claim 2, wherein said house includes means for passing fluid under pressure to two separate areas of said through bore such that when fluid is passed to a first area, said piston is caused to move from a first axial position to a second axial position, and when fluid is passed to a second area, said piston is caused to move from said second axial position to said first axial position; said device engaging the respective adjacent teeth of both said element and said piston only when said piston moves from said first axial position to said second axial position.

4. The torque applicator as defined in claim 3, wherein said teeth disposed along a portion of the surface of said torque applicator stem and said teeth disposed along said piston engaged with said teeth disposed along a portion of the surface of said torque applicator stem interact to cause rotation of said torque applicator stem when said piston is moved from said first axial position to said second axial position.

5. The torque applicator as defined in claim 4, wherein said teeth disposed along a portion of said surface of said torque applicator stem are axial teeth.

6. The torque applicator as defined in claim 3 wherein said teeth disposed along a portion of said surface of said torque applicator stem are helical teeth.

7. The torque applicator as defined in claim 3, wherein said head portion of said piston is positioned at one end of said elongated portion thereof, wherein said house has end walls connected to said inner wall which together form said through bore, wherein said means in said house for passing fluid under pressure to respectively a first area and a second area comprises two passageways in said inner wall communicating respectively to a space between said head portion of said piston and a first of the end walls of said house and to a space between said head portion of said piston and a second of the end walls; and wherein upon the supply of fluid to the first area between said head portion of said piston and said first end wall of said house, said piston is caused to move from said first axial position; the movement of said piston from said first position to said second position causing engagement between said element and said piston by means of said teeth means capable of engaging said piston and said element such that said torque applicator stem is rotated.

* * * * *